US005245940A

United States Patent [19]

Rockwood

[11] Patent Number: 5,245,940

[45] Date of Patent: Sep. 21, 1993

[54] LOAD LIFTING DEVICE

[76] Inventor: Joseph C. Rockwood, 2441 St. Clair River Rd., Algonac, Mich. 48001

[21] Appl. No.: 913,033

[22] Filed: Jul. 14, 1992

[51] Int. Cl.[5] ..... B63C 1/02

[52] U.S. Cl. ..... 114/48; 405/3; 187/11

[58] Field of Search ..... 114/44, 48, 366; 187/11; 405/3

[56] References Cited

U.S. PATENT DOCUMENTS

| | | | |
|---|---|---|---|
| 4,588,155 | 5/1986 | James . | |
| 4,678,366 | 7/1987 | Williamson | 405/3 |
| 4,983,067 | 1/1991 | Montgomery | 114/44 |
| 5,143,182 | 9/1992 | Basta | 114/48 |

FOREIGN PATENT DOCUMENTS

| | | |
|---|---|---|
| 267488 | 9/1911 | Fed. Rep. of Germany . |
| 659656 | 4/1938 | Fed. Rep. of Germany . |
| 1056540 | 4/1959 | Fed. Rep. of Germany . |
| 625521 | 8/1927 | France . |
| 2233309 | 1/1991 | United Kingdom . |

*Primary Examiner*—Jesus D. Sotelo
*Attorney, Agent, or Firm*—Brooks & Kushman

[57] ABSTRACT

A load lifting device for small watercraft has a vertical post having a lower post portion extending downwardly in the water from the top of the dock and rigidly mounted thereto and having an upwardly extending rectilinear extension and a vertically moveable cradle cantilevered off the post with a winch at the top of the extension connected to the cradle for raising and lowering it; the upwardly extending extension of the post being mounted on the lower post portion for rotation relative thereto so that when the cradle is moved vertically to a position carried by the extension it may revolve with such extension to swing a watercraft carried by the cradle over the dock or the water as desired. A lock is provided for preventing the post and extension from rotating during transition of the cradle between the two.

15 Claims, 3 Drawing Sheets

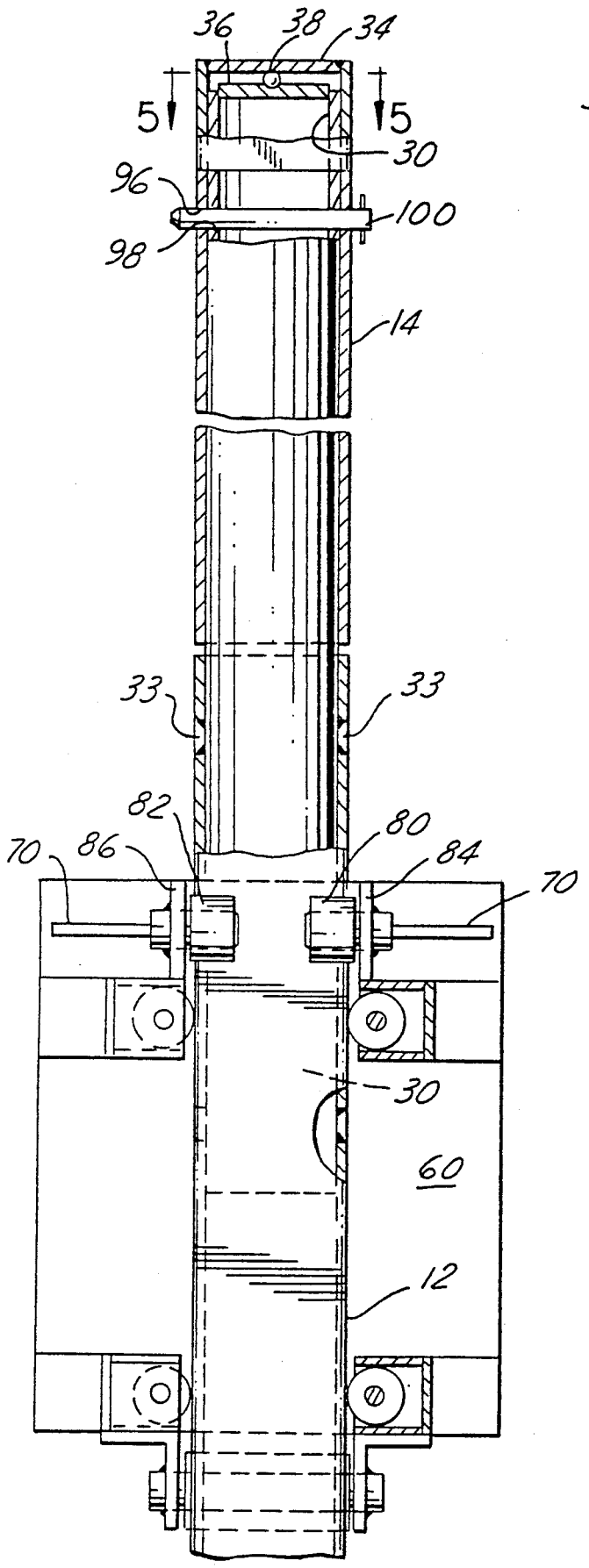
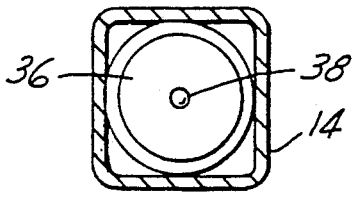
FIG.5
FIG.4

LOAD LIFTING DEVICE

FIELD OF THE INVENTION

This invention relates to a load lifting device particularly. Though not exclusively, adapted for hoisting small watercraft out of the water and setting them on the adjacent land.

BACKGROUND OF THE INVENTION

With the advent of what is sometimes referred to as motorized personal watercraft sold under the trademarks WAVERIDER, JET SKI and the like, which may weight three hundred or more pounds, a need has arisen to be able to easily place such craft in or remove them from the water at a seawall, such as from a docking area (as distinguished from a beach or launching ramp) utilizing a structure that while permanently mounted is of low profile that will not substantially interfere with the view of the water, and which may be easily removed for winter storage or servicing. Prior art devices in the form of davits, overhead cranes or hoists having a horizontal beam swingable at the top of a vertical column with a chain falls or the like hanging from the beam, all present substantial obstruction of views and require considerable installation costs.

Accordingly, a need has arisen for a low-profile hoist for small water-craft that may be easily and inexpensively installed at the seawall, which will pickup a craft in the water, lift it up and over the seawall and deposit it on the ground or on a trailer, as desired, or return it to the water, and which may be fabricated for a low enough cost that it may be sold for a modest price.

SUMMARY OF THE INVENTION

In a preferred embodiment a square post is driven into the bottom under the water adjacent the seawall or dock with its upper end substantially flush therewith. The upper end of this post is secured to the seawall or dock. A a short (30") rectilinear extension of this post is then mounted on the upper end of it for swivelling movement about their common axis. A winch is mounted on the upper end of the extension post with a lifting cable extending down to a watercraft supporting cradle cantilevered on rollers to slide up and down the post and extend either out over the water or over the land depending on the swivelled position of the extension post. To retrieve a watercraft from the water, the cradle is lowered by the winch beneath the water surface and the watercraft is moved over the cradle and the the cradle is raised lifting the watercraft. The cradle is raised by the winch sufficiently so that the cradle rollers pass onto the extension post and the cradle is supported solely by the extension post above the upper end of the dock or seawall. The extension post with the cradle carried thereby is then rotated on its axis to swing the watercraft over the land. The hoist if then operated to lower the cradle to set the watercraft on the ground, trailer or land supports. Suitable locking devices may be provided to ensure alignment of the post and its extension during raising and lowering of the cradle so that the transition between the post and extension by the rollers of the cradle is trouble free.

BRIEF DESCRIPTION OF THE DRAWINGS

FIG. 4 is a cross-sectional view taken on the line 4—4 of FIG. 1; and

FIG. 5 is a cross-sectional view taken on the line 5—5 of FIG. 4.

BRIEF DESCRIPTION OF PREFERRED EMBODIMENT

Figure 1:
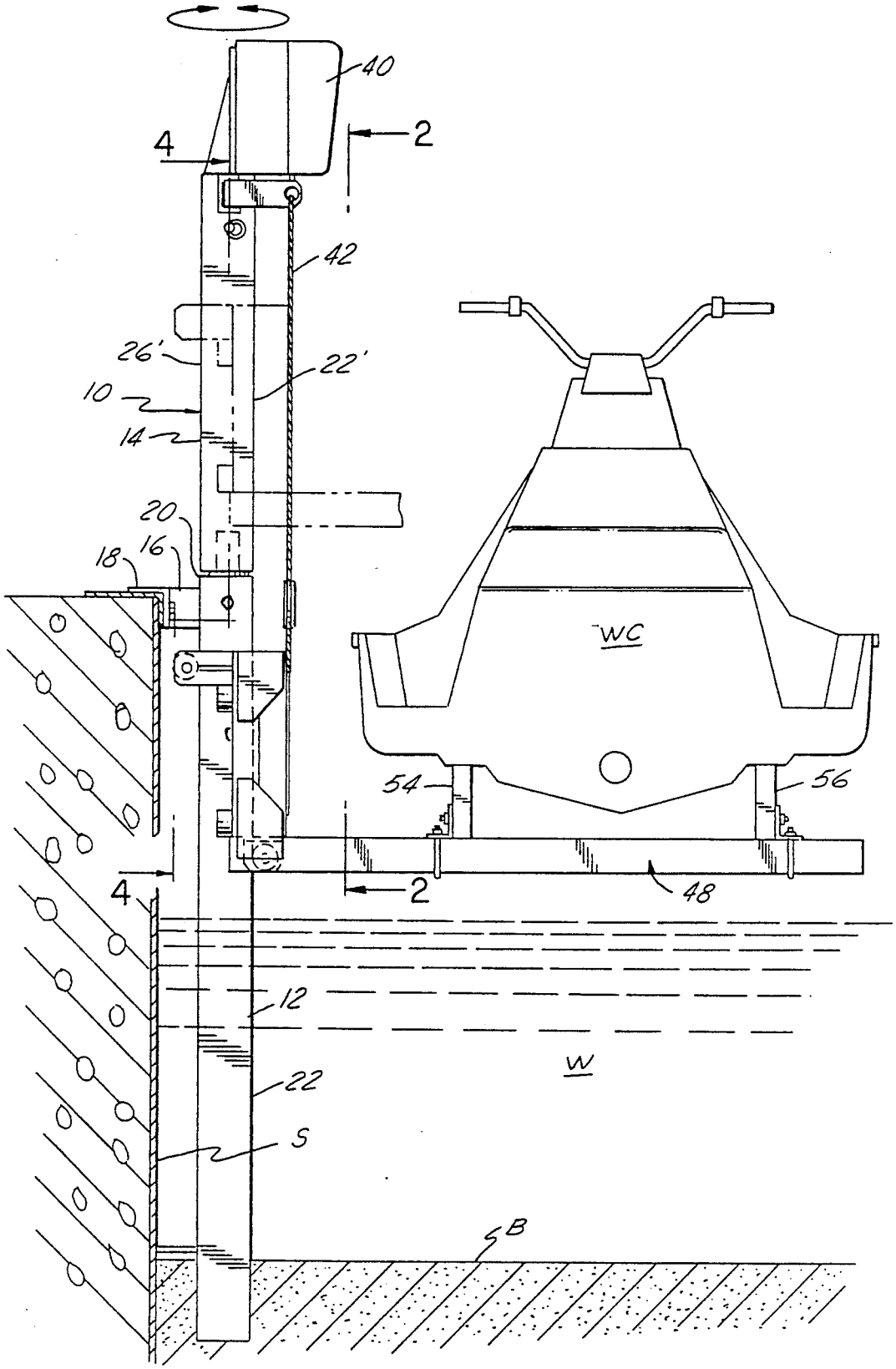
FIG. 1 is a side elevation of a load lifting device embodying the invention.

FIG. 1 illustrates the general arrangement of the load lifting device as embodied in hoist for small watercraft WC. The device comprises an elongated vertical post generally indicated at 10 having a lower post portion 12 and a separable upper post portion 14. The lower post portion is intended to be driven at its lower end into the bottom B beneath the water W adjacent a seawall or dock S prior to mounting the upper portion 14 thereon. Means in the form of a bracket 16 comprising a vertical web welded at its outer end to the lower post and at its inner end provided with an L-shaped portion, is bolted or otherwise secured to the seawall to stabilize or rigidify the upper end 18 of the lower post 12. The upper end 18 is substantially flush with the top of the seawall or dock as shown.

The post is of tubular configuration, polygonal in cross-section, preferably square, to present opposite faces 22, 24, 26 and 28, indicating the faces of the lower post portion 14, while corresponding faces of the upper post portion 14 are indicated by corresponding primed reference numerals. These faces present surfaces for supporting load carrying rollers as hereafter described.

The lower post portion 12 is sometimes herein referred to simply as the post while the upper post portion 14 is sometimes referred to as the post extension member. In any event, the post extension member 14 is carried and supported solely by the post portion 12 as a rectilinear extension thereof for rotation about the common vertical axis of the two members. For this purpose the post 12 is provided with a cylindrical tube 30 serving as a cylindrical bearing. The tube 30 extends down into the lower member in a slip fit terminating at a lower end 32 and is welded or otherwise rigidly secured in the post as at 33. The cylindrical bearing or tube 30 extends in a slip fit slidably and rotatably upwardly through the post extension 14 to proximate the upper closed end 34 thereof. The upper end of tube 30 is closed by an end wall 36 and is provided with a central depression within which is disposed an anti-friction bearing 38 in the form of a hardened steel ball which bears against the underside of end member 34 of the post extension and provides a low friction support for the compressive loading between the post extension 14 and the post 12.

In a typical installation the post extension 14 may extend above the post 12 approximately 30", and the post may be a square steel tube 4" on a side with a 3/16" wall thickness. This provides a relatively inconspicous structure extending above the top of the seawall or dock.

Figure 2:
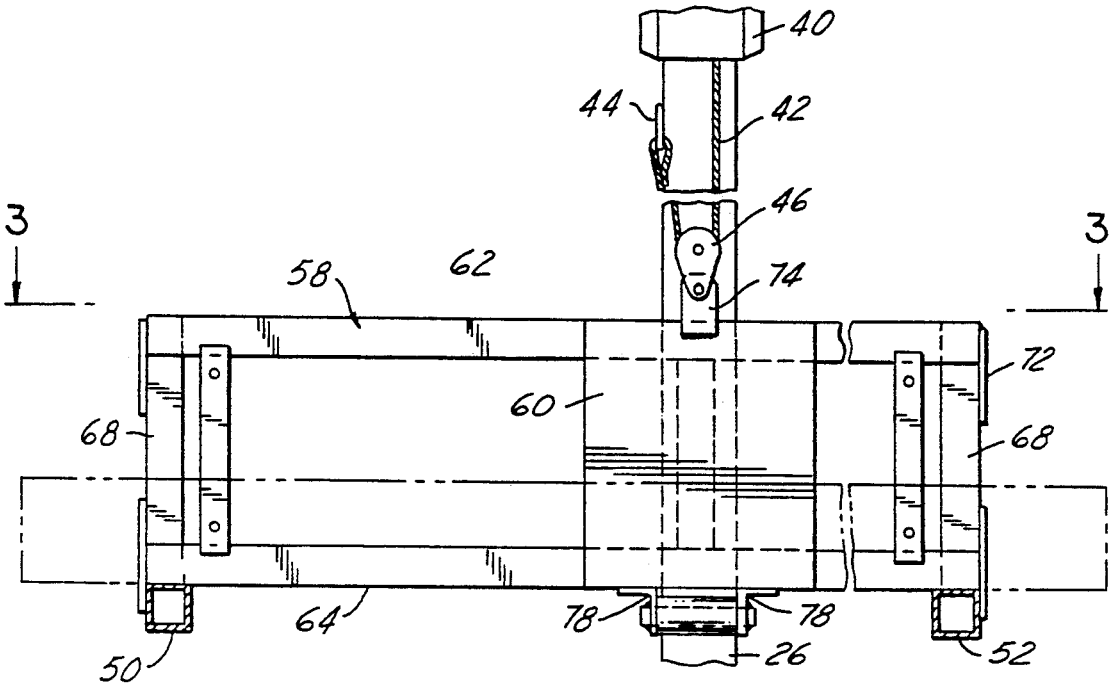
FIG. 2 is a cross-sectional view taken on the line 2—2 of FIG. 1.
Figure 3:
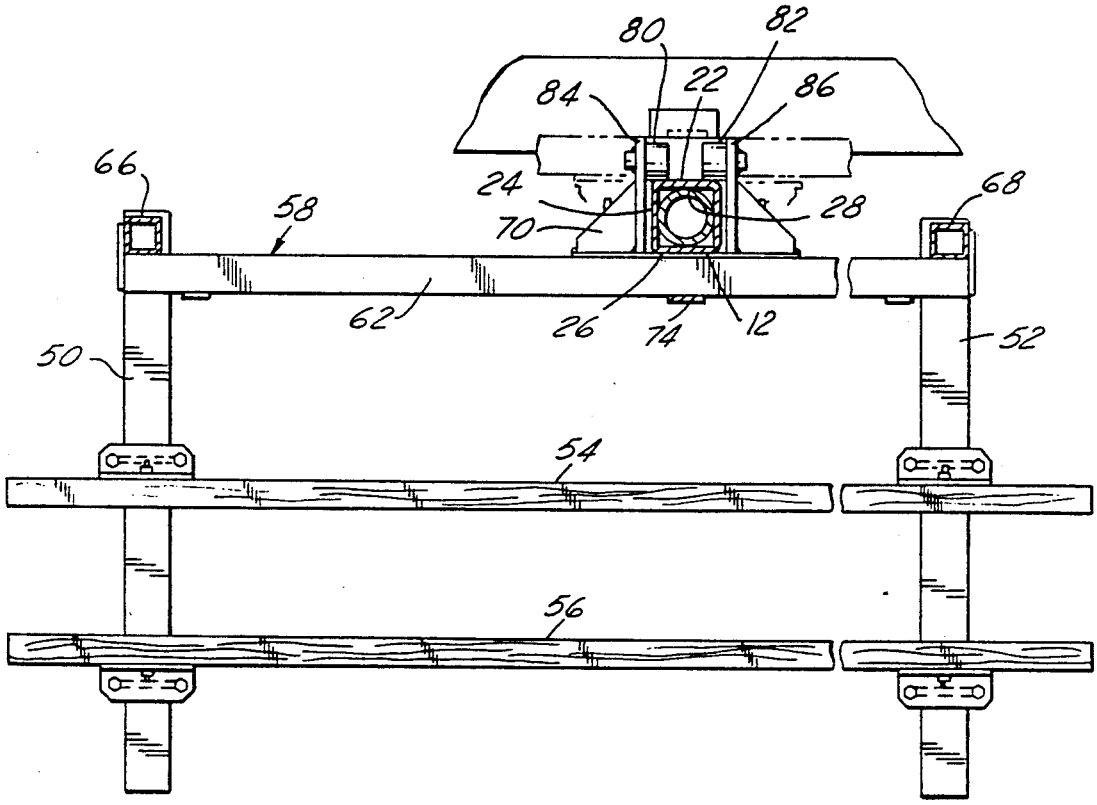
FIG. 3 is a cross-sectional view taken on the line 3—3 of FIG. 2.

Rigidly mounted on the top of the post extension is a winch 40 which is preferably electrically driven and provided with a cable 42 providing a hoist means for connecting the winch to the load supporting cradle C. To increase the lift capacity of the winch, which may be readily purchased commercially from several sources, the cable may have a double purchase as shown in FIG. 2. where the end is connected to a hook 44 on the post extension and the bight of the cable is led through a block 46 secured to the cradle C.

The watercraft or load supporting cradle C is cantilevered on the post 10 and extends laterally therefrom for vertically sliding movement therealong and between the upper and lower post portions 12 and 14 and is arranged to be disposed beneath a watercraft WC to lift or lower the same. In general the cradle comprises a horizontal platform 48 consisting of laterally spaced tubular members 50 and 52 across which are secured the watercraft supporting bunks 54 and 56 upon which the watercraft sits when lifted or lowered as shown in FIG. 1. The tubular members 50 and 52 are secured to the bottom of a vertical cradle structure generally indicated at 58 and comprising a plate 60 to which are secured at the upper and lower edges a pair of tubes 62 and 64 to the ends of which are secured vertical members 66 and 68. Suitable gussetts such as 70 and 72 may be provided to reinforce the points of connection of these several structural members as desired. The block 46 is connected to member 62 by a strap 74.

The cradle C is mounted on the post for vertical sliding movement and guided against uncontrolled rotation by several load supporting rollers. These rollers bear against the faces 22,24,26 and 28 of the post. These faces are disposed substantially perpindicular to the various moment arms present in the structure. Two of these faces, 22 and 26, are disposed perpendicular to the cantilever bending moments of the cradle C on the post. To accomodate such forces a roller 76 is mounted on the lower tube 64 between a pair of brackets 78 and rides against face 26 proximate the platform 48 while a pair of rollers 80 and 82 spaced apart to straddle the bracket 16 are mounted on a pair of standoffs 84 and 86 to ride the face 22 remote from the platform. To prevent the cradle from twisting or rotating relative to the post portion upon which it is riding, side rollers are provided. Such rollers are indicated at 88,90,92 and 94 and are arranged in two pairs with a pair bearing against the faces 24 and 28 of the post. The rollers are mounted on short shafts secured to the plate 60. The side rollers will prevent the cradle from rotating about a horizontal axis in the event the load is not uniformly distributed on the cradle and will also prevent the cradle from rotating about the axis of the post portion 12 and will require the cradle to rotate with the post extension 14 when such is permitted to swivel on the the post 12.

To prevent the upper and lower post portions 12 and 14 from uncontrolled relative rotation, and in particular to insure alignment of the faces 22,24,26 and 28 of the post with the corresponding faces 22', 24', 26', and 28' during transition of the cradle from being carried by the post 12 to being carried by the post extension 14, post locking means is provided. Such means comprise aligned holes 96 and 98 respectively in the post extension 14 and the cylindrical tube 30 at a convenient height above the seawall or dock through which a pin 100 is removably extended as shown in FIG. 4.

It is thus apparent that I have disclosed a device for recovering or launching a small watercraft off a seawall or dock, which is of simple construction and easily installed and will offer a minimum of obstruction to either the view or the weather. If desired the post extension may be readily removed for winter storage by simply lifting it off the interior cylindrical tube.

What is claimed is:

1. A load lifting device for raising or lowering a load and when raised swinging it about a vertical axis for further raising or lowering comprising, in combination:

an elongated vertical post member of polygonal cross-section having an upper end;

a post extension member of the same polygonal cross-sectional configuration as the post member and forming an extension of the post member and mounted coaxially on the upper end thereof for rotatable movement about their common axis and having an upper end;

a winch mounted on the upper end of said extension member and carried thereby for rotation therewith;

a load supporting cradle cantilevered on one of said members and extending laterally therefrom and having an upwardly facing load supporting surface;

means for supporting the cradle on said members for vertically sliding movement therealong and transition between the post member and the extension member;

hoisting means extending between said winch and cradle for raising and lowering the cradle upon operation of the winch; and means for supporting said extension member on the post member for rotatable movement thereon when the cradle is cantilevered off the extension member whereby the cradle, winch and hoisting means may be conjointly swung around the axis of said members.

2. The invention defined by claim 1 wherein means are provided for locking the post and extension members in relative rotated positions where corresponding polygonal faces are in vertical alignment to facilitate transition of the cradle between the post and the extension.

3. The invention of claim 1 wherein said means for supporting the extension member on the post member comprises bearing means for supporting such members against axial compressive loading and transverse bending moments therebetween.

4. The invention defined by claim 3 wherein said bearing means includes an anti-friction bearing.

5. The invention defined by claim 1 wherein one of said post or extension members is hollow and the other member has a cylindrical bearing portion extending axially therefrom and rotatably received and supported within the said one hollow member with such bearing portion supporting the members against lateral bending moments for relative rotation therebetween.

6. The invention defined by claim 5 wherein the extension post member is hollow and provided internally at its upper end with a transverse bearing support; said post member having a vertical cylindrical extension portion secured therein and extending thereabove and telescoped within the hollow extension post member and having an upper end within the hollow extension post member; and anti-friction bearing means disposed between the upper end of said cylindrical extension portion and said transverse bearing support to carry compressive loading forces between the post and extension members.

7. The invention defined by claim 5 wherein anti-friction bearing means is provided between the post and extension members for supporting vertical compression loading therebetween.

8. The invention defined by claim 1 wherein the means for supporting the cradle on said members comprises load bearing rollers disposed on opposite sides of such members for rolling movement vertically therealong.

9. The invention defined by claim 1 wherein some of said polygonal faces are generally parallel and disposed perpendicular to the cantilevered moment forces of said cradle and the means for supporting the cradle on said members comprises load bearing rollers disposed to engage said faces to resist the cantilever moment forces while permitting vertical movement of the cradle on the post members.

10. The invention defined by claim 1 wherein the post and extension members are of square cross-sectional shape and said means for supporting the cradle cantilevered on such members comprises load bearing rollers disposed against opposite faces of such square shape.

11. The invention defined by claim 1 wherein said cradle comprises a horizontal platform portion and a vertical side portion rigidly secured together with the platform portion arranged to be received beneath and support thereon the load to be carried, and the vertical side portion having adjacent its upper edge roller means for engaging that side of the post and extension members remote from the cradle and the lower edge of the side portion having roller means for engaging that side of the post and extension members proximate the cradle, and said vertical side portion further including roller means engaging the post and extension members between the faces proximate and remote from the cradle to support the cradle for rectilinear travel along the post and extension members.

12. A launching and recovery device for small watercraft to be installed adjacent a dock or seawall, comprising, in combination:

an elongated vertical post having separable upper and lower portions;

said lower portion having a lower end for support on the bottom beneath the water adjacent a seawall or dock and an upper end to be disposed at the upper edge of the seawall or dock;

means for rigidly connecting the upper end of the lower post portion to the dock or seawall;

bearing means for supporting the upper post portion on the lower post portion for rotatable movement therebetween about their common axis;

said upper post portion having an upper end and a winch fixedly mounted on such upper end and rotable therewith;

a watercraft supporting cradle cantilevered on said post and extending laterally therefrom for vertically sliding movement therealong and between the upper and lower post portions and arranged to be disposed beneath a watercraft to lift the same;

hoisting means extending between said winch and cradle for raising and lowering the cradle upon operation of the winch; and roller means disposed between the post and cradle for supporting the cradle on the post for vertical movement.

13. The invention defined by claim 12 wherein the post has vertically extending generally planar faces disposed substantially perpendicular to the cantilever forces of the cradle, and said roller means are positioned to bear against such faces.

14. The invention of claim 13 wherein means are provided for selectively preventing relative rotation between the upper and lower post portions.

15. The invention of claim 12 wherein means are provided for selectively preventing rotation between the upper and lower post portions.

* * * * *